US005204583A

United States Patent [19]

Jeong

[11] Patent Number: 5,204,583

[45] Date of Patent: Apr. 20, 1993

[54] FILAMENT SUPPORTER FOR USE IN VACUUM FLUORESCENT DISPLAY TUBES AND METHOD FOR FILAMENT INSTALLATION

[75] Inventor: Jingyu Jeong, Kyeongsangnam, Rep. of Korea

[73] Assignee: Samsung Electron Devices Co., Ltd., Kyunggi, Rep. of Korea

[21] Appl. No.: 781,489

[22] Filed: Oct. 21, 1991

[30] Foreign Application Priority Data

Oct. 24, 1990 [KR] Rep. of Korea ..... 90-17186

[51] Int. Cl.[5] ..... H01J 9/04; H01J 9/18; H01K 63/02; H01K 63/06

[52] U.S. Cl. ..... 313/496; 313/274; 313/278; 445/29; 445/33

[58] Field of Search ..... 313/496, 274, 278, 497; 445/29, 32, 33

[56] References Cited

U.S. PATENT DOCUMENTS 3,745,401 7/1973 Stapleton et al. ..... 313/278 X
4,023,876 5/1977 Fukunaga et al. ..... 313/497 X
4,377,766 3/1983 Lenz et al. ..... 313/497 X

FOREIGN PATENT DOCUMENTS 28164 2/1983 Japan ..... 313/496

*Primary Examiner*—Palmer C. DeMeo
*Attorney, Agent, or Firm*—Christie, Parker & Hale

[57] ABSTRACT

A method for safe and tight installation of a filament using a supporter obviates the need for welding. The supporter has an upstanding member such as a wing formed on the top of upward extensions from its surface. The member is located on one side of a plate of the supporter and has a clamping groove to hold and fix the end of the filament. The filament also can be wound around a lower part of the member thereby fixing the filament without welding.

3 Claims, 3 Drawing Sheets

FILAMENT SUPPORTER FOR USE IN VACUUM FLUORESCENT DISPLAY TUBES AND METHOD FOR FILAMENT INSTALLATION

FIELD OF THE INVENTION

The present invention relates to a conventional vacuum fluorescent display tube and, more particularly, to a structure for tightly supporting a filament and a method for installing a filament using the same.

BACKGROUND OF THE INVENTION

Vacuum fluorescent display tubes for displaying numerals or other characters have been widely used, such as in computers, measuring apparatus and calculators, to provide a visual display of information. The tubes are conventionally formed such that filaments, a grid electrode, anode segments, and a pair of filament supporters are placed within an evacuated envelope which is formed by a spacer interposed between a pair of transparent substrates made of glass.

A typical fluorescent display tube is described in connection with FIG. 3.

Distributing wires (not shown) for supplying voltage, anode segments 8, a grid electrode 10 and filaments 12 are layered on a lower substrate 4. A pair of metal filament supporters 14 are placed thereon at opposite ends of substrate 4 at a predetermined distance from each other to support each end of the filaments. Supporter 14 is welded and connected to a base 15 fixed on the lower substrate 4 by a print 16. Anode segments 8 are formed thereon in a predetermined pattern. Each anode segment is covered with a fluorescent material such as various phosphors. An insulating layer 5 is formed at region other than the anode segments. Grid electrode 10 including a fine wire mesh is placed thereon in a predetermined interval. Tungsten filaments 12 are suspended above the grid electrode by a suitable supporter, so that they can emit electrons toward the anode segments. Thereafter, a spacer 6 is placed on substrate 4 and an upper substrate 2 is placed on spacer 6 which provides a predetermined space between and around the glass substrates 2, 4, thus forming an evacuated envelope 7 to complete the display tube.

However, the length of filament may vary due to heat generated from the electric current during operation. Such variations mean that the interval between grid electrode 10 and filaments 12 cannot be consistently uniformly kept, thereby causing a poor display created by anode segments 8. Thus, the filaments 12 should be suspended in tension so as to be held above and across electrode 10. A metal supporter is used to thereby solve this heat/expansion problem.

A conventional metal supporter 14 is described in connection with FIG. 4A showing its general form.

A plurality of extensions 142 extend upwardly from a surface adjacent one side edge of a plate 140 of the supporter. The end of each filament 12 is welded to and fixed on top of each extension 142.

FIG. 4B shows another form of a supporter 14*a*.

A plurality of extensions 144 extend upwardly from plate 140 and have a self-elasticity, to apply some tension to the filaments 12 welded to their tops.

However, the connection by welding both ends of the filaments to the supporters causes the change in quality of the filaments due to heating during welding thereby forming a weak part against the tension. Further, an equipment for welding together with a means for placing the filaments on the exact place for welding are required thereby resulting in the complex structure.

SUMMARY OF THE INVENTION

Accordingly, the present invention proposes means and a method for overcoming the above-mentioned difficulties. One aspect of the present invention is a metal supporter fixing filaments independently of welding. Another aspect of the present invention is a method for installing filaments on the supporter.

Conventionally, anode segments, a grid electrode, filaments and a pair of filament supporters are placed within an evacuated envelope. A plurality of extensions for installing the filaments may be extended upwardly from a surface on one side edge of a plate of each supporter. Further, each top of the extensions is provided with a upstanding member having two parts may be horizontally divided by a clamping groove. The groove receives and holds the end of the filament. The edge of at least one of these two parts should be rounded in order to easily wind the filament around its body.

BRIEF DESCRIPTION OF THE DRAWINGS

Further features and advantages of the present invention will be apparent in the following detailed description taken in conjunction with the accompanying drawings, wherein.

DETAILED DESCRIPTION OF THE INVENTION

Figure 1:
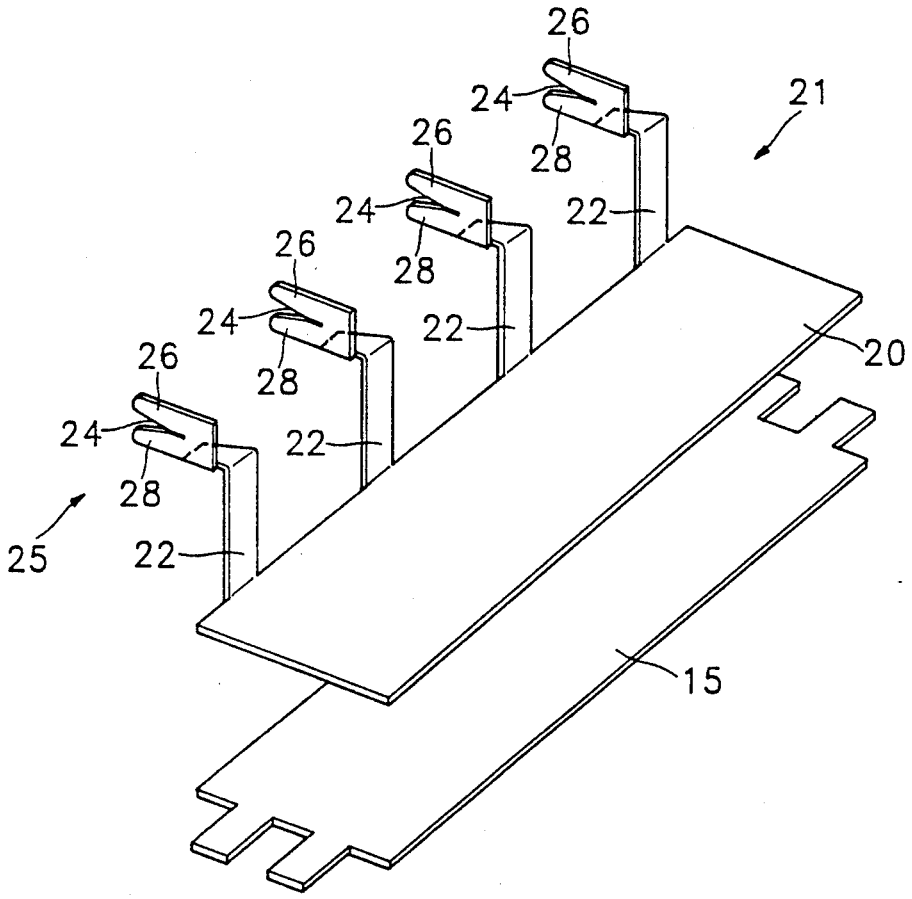
FIG. 1 is a perspective view of a filament supporter according to the present invention.

A filament metal supporter according to the present invention is provided with a plurality of extensions 22 or projections for tightly installing filaments. They are extended upwardly from a surface on one side edge of a plate 20 of supporter 21. Each top of the projections is outwardly bent perpendicular to the extensions and parallel with the plate. One side edge of this top is provided with an upstanding member 25 in the form of a wing perpendicular to the top surface of the projections. This member is provided with two parts horizontally divided by a clamping groove 24. This groove can hold and grasp the end of a filament. The edge of at least one of two parts is rounded to easily wind the filament around its body. When considering the degree of strength of the wing members extended upwardly from its surface on one side of the supporter, the length of the clamping groove is preferably no more than about one third of the whole length of the upstanding member 25. Further, the diameter of the clamping groove 24 from the starting point of the groove is preferably less than that of the filament for about one fourth of the length of the groove, so that the filament can be more tightly and safely grasped by this groove. In practice, the diameter of the filament for use in the vacuum fluorescent display tube is under about 0.3 mm. Thus, the groove 24 has a thin slot of less than that. A pair of filament supporters are placed in the evacuated envelope 7 facing and being a predetermined distance from each other The method for installing filaments using filament supporter 21 will be described in detail in connection with FIGS. 2A and 2B.

Figure 2A:
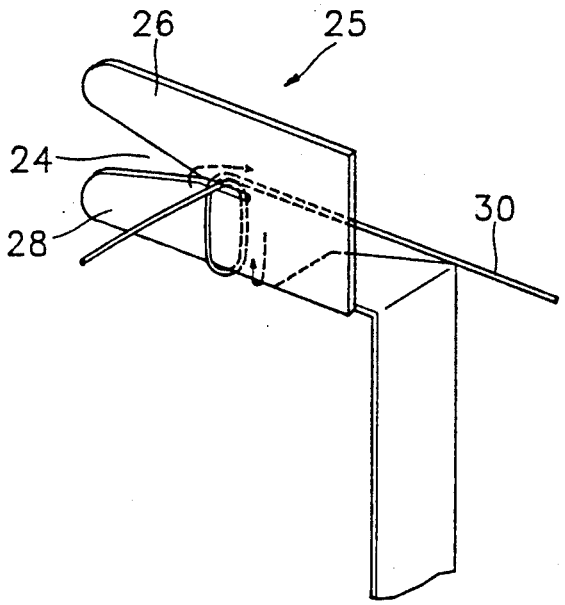
FIG. 2A is a partial perspective view showing the initial step for placing a filament on a supporter.

As illustrated in FIG. 2A, the groove 24 grips the end of a filament 30. Thereafter, the filament 30 is wound around lower part 28 of upstanding member 25 by outwardly bending it perpendicular to this extension and parallel to the plate 20 along the arrow direction shown in FIG. 2A, which can prevent the filament 30 from slipping through the groove 24.

Figure 2B:
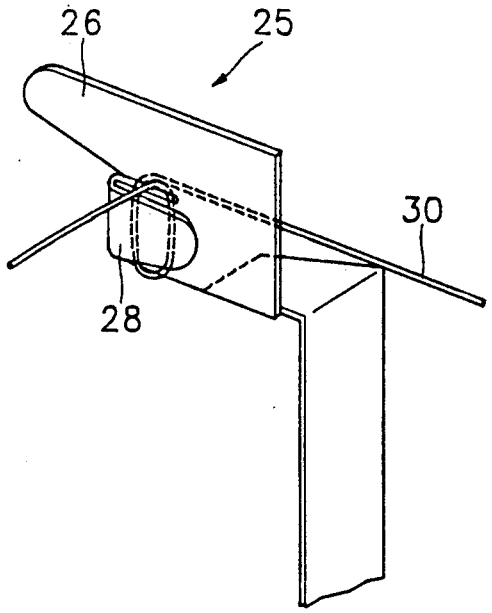
FIG. 2B is a partial perspective view showing the last step for placing a filament on a supporter.
Figure 3:
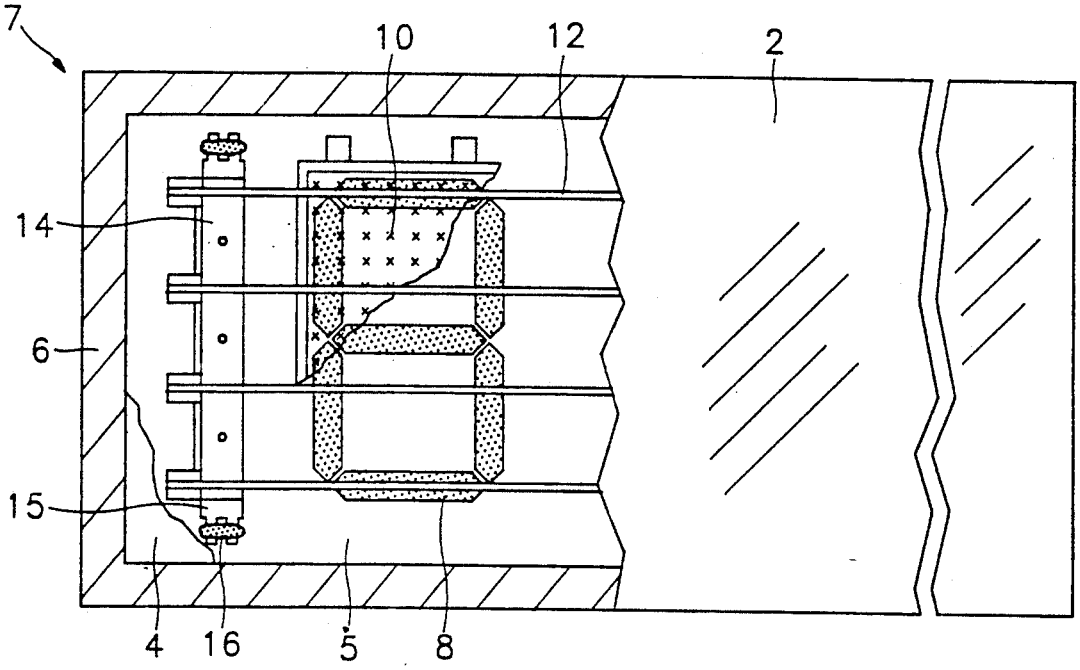
FIG.3 (Prior Art)
FIG. 3 is a sectional view of a conventional fluorescent display tube.
Figure 4A:
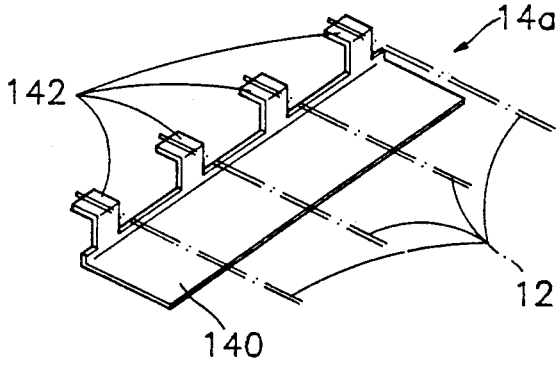
FIG.4A (Prior Art)
FIG. 4A is a perspective view of one embodiment of a filament supporter disposed in a fluorescent display tube.
Figure 4B:
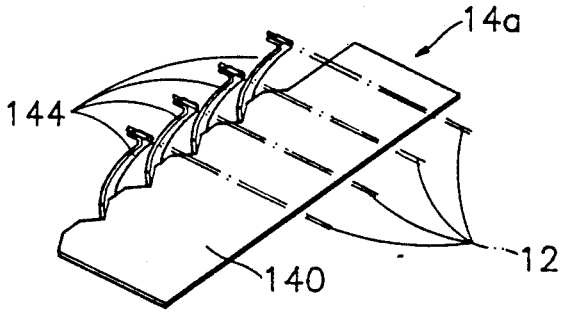
FIG.4B (Prior Art)
FIG. 4B is a perspective view of another embodiment of a filament supporter disposed in a fluorescent display tube.

As shown in FIG. 2B, lower wing 28 is folded inwardly to keep filament 30 wound on the lower part 28 of upstanding member 25. When folding the lower part 28 of upstanding member 25, a appropriate tool, such as pinchers or pliers, can be used.

Accordingly, the present invention allows the safe and tight installation of the filament by the supporter independently of welding. Further, as the connection is securely formed, it can provide a vacuum fluorescent display tube having a longer useful life. Also, a method of the fabrication should rarely produce poor goods with disconnected filaments. The present invention has the advantage of cost reduction owing to elimination of expensive equipment for welding.

What is claimed is:

1. A method for installing a filament on a filament supporter for use in a fluorescent display tube, said supporter comprising a metallic plate, a plurality of spaced metallic projections extended upwardly from the plate for installing filaments, a top portion bent and transverse to the projection, an upstanding member formed transverse to the top portion, and two parts separated by a clamping groove formed in the upstanding member for receiving the filament therein, the method comprising the steps of:

inserting the filament into the groove formed in the upstanding member of the filament supporter;

winding the filament around a lower part of the upstanding member; and folding the lower part of the upstanding member over said filament.

2. A filament supporter for use in a vacuum fluorescent display tube, comprising:

a metallic plate; and a plurality of spaced metallic projections extending from said plate each projection comprising a lower member which is perpendicular to the plate, each of said projections further comprising:

a top portion which is perpendicular to the lower member; and an upstanding member which extends from one side edge of the top portion and is perpendicular to the plate, said upstanding member including upper and lower wings separated by a clamping groove formed in said upstanding member, said lower wing being bent so as to sandwich a filament between said lower wing and said upstanding member.

3. The supporter as claimed in claim 2, wherein a free end of at least one of said upper and lower wings is rounded.

* * * * *